US006993840B2

(12) United States Patent
Mouri et al.

(10) Patent No.: US 6,993,840 B2
(45) Date of Patent: Feb. 7, 2006

(54) MANUFACTURING METHOD OF LIQUID JET HEAD

(75) Inventors: Akihiro Mouri, Tokyo (JP); Nobuhito Yamaguchi, Tokyo (JP); Hidehito Takayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 411 days.

(21) Appl. No.: 10/618,676

(22) Filed: Jul. 15, 2003

(65) Prior Publication Data

US 2004/0021745 A1 Feb. 5, 2004

(30) Foreign Application Priority Data

Jul. 18, 2002 (JP) ..... 2002-209110

(51) Int. Cl.

| | |
|---|---|
| ***B21D 53/76*** | (2006.01) |
| ***G01D 15/00*** | (2006.01) |
| ***G11B 5/271*** | (2006.01) |
| ***B41J 2/045*** | (2006.01) |
| ***B05D 1/36*** | (2006.01) |

(52) U.S. Cl. ..... 29/890.1; 29/25.35; 29/DIG. 16; 216/27; 347/68; 427/264; 427/270; 427/271

(58) Field of Classification Search ..... 29/890.1, 29/25.35, DIG. 16; 347/68–72; 216/27, 216/36; 427/100, 105, 264, 270, 336, 271
See application file for complete search history.

(56) References Cited

U.S. PATENT DOCUMENTS

| | | | | |
|---|---|---|---|---|
| 4,565,859 A | | 1/1986 | Murai et al. | |
| 5,218,376 A | | 6/1993 | Asai | |
| 5,458,254 A | * | 10/1995 | Miyagawa et al. | 216/27 |
| 5,478,606 A | * | 12/1995 | Ohkuma et al. | 427/555 |
| 5,983,486 A | * | 11/1999 | Shimomura et al. | 29/611 |
| 5,984,459 A | * | 11/1999 | Takahashi et al. | 347/70 |
| 6,347,862 B1 | | 2/2002 | Kanno et al. | |

FOREIGN PATENT DOCUMENTS

| | | |
|---|---|---|
| JP | 54-161935 | 12/1979 |
| JP | 60-161973 | 8/1985 |
| JP | 61-185455 | 8/1986 |
| JP | 61-249768 | 11/1986 |
| JP | 63-221121 | 9/1988 |
| JP | 64-9216 | 1/1989 |
| JP | 2-140219 | 5/1990 |
| JP | 4-10940 | 1/1992 |
| JP | 4-10941 | 1/1992 |
| JP | 10-286953 | 10/1998 |
| WO | WO 98/46429 | 10/1998 |

OTHER PUBLICATIONS

J.V. Crivello et al. "New Photoinitiators for Cationic Polymerization," Journal of Polymer Science, Polymer Symposium No. 56 (held Jun. 20-24, 1976), pp. 383-395 (published 1977).

* cited by examiner

*Primary Examiner*—A. Dexter Tugbang
*Assistant Examiner*—Tai Nguyen
(74) *Attorney, Agent, or Firm*—Fitzpatrick Cella Harper & Scinto

(57) ABSTRACT

A manufacturing method of a liquid jet head comprises the following steps of forming a piezoelectric member which generates a discharge pressure for discharging a liquid on a substrate, disposing a vibration plate on the piezoelectric member, forming a liquid flow path pattern containing a soluble resin on the vibration plate, forming a coat layer containing a resin constituting a wall of the liquid flow path on the liquid flow path pattern, removing the liquid flow path pattern to form the liquid flow path, removing the substrate, and patterning the piezoelectric member in accordance with the liquid flow path.

12 Claims, 8 Drawing Sheets

MANUFACTURING METHOD OF LIQUID JET HEAD

BACKGROUND OF THE INVENTION

1. Field of the Invention

The present invention relates to a manufacturing method of a liquid jet head for discharging/flying droplets to attach the droplets to a recording medium.

2. Description of the Related Art

A liquid jet system (ink jet system) is one of so-called non-impact recording systems, and has characteristics that generation of noises at a recording time is small to an ignorable degree, high-speed recording and recording with respect to various recording mediums are possible, the recording is fixed even to a so-called plain paper without requiring any special treatment, and a high-precision image is inexpensively obtained. From these advantages, the head has rapidly spread not only in a printer which is a peripheral apparatus of a computer but also in a printing system such as a copying machine, facsimile, and word processor these several years.

In these days, for liquid discharge methods of a liquid jet apparatus for broad and general use, there have been a method of using an electrothermal conversion element (heater), and a method of using a piezoelectric element (piezo element). In either method, it is possible to control the discharge of the droplets by an electric signal.

For the method in which the electrothermal conversion element is used, when the electric signal is supplied to the electrothermal conversion element, a liquid in the vicinity is momentarily boiled. At this time, bubbles rapidly grow by a phase change of the liquid and the droplets are discharged at a high speed. Therefore, this method has advantages that the structure of the liquid jet head is simple and nozzles are easily integrated. On the other hand, problems peculiar to this method include a volume fluctuation of flied droplets by heat accumulated in the liquid jet head, and adverse influence of cavitation by debubbling onto the electrothermal conversion element.

To solve these problems, for example, there are liquid jet recording methods and liquid jet heads described in Japanese Patent Application Laid-Open Nos. 54-161935, 61-185455, 61-249768, 4-10940, and 4-10941. The liquid jet recording methods described in these are characterized in that the bubbles generated on the electrothermal conversion element in response to a recording signal are communicated with outside air. This is concretely achieved by droplet discharge means in which a distance between the electrothermal conversion element and discharge port is reduced. With the use of such method, enhancement of volume stability of the flied droplets, high-speed small droplets recording, and enhancement of durability of the electrothermal conversion element by elimination of the cavitation are possible, and a highly fine image is easily obtained.

Moreover, in the method in which the piezoelectric element (piezo element) is used, for example, an apparatus constituted of a liquid supply chamber communicated with the liquid discharge port, a pressure chamber communicated with the liquid supply chamber, and a vibration plate which is disposed in the pressure chamber and to which the piezoelectric element is bonded is used. A discharge direction of the liquid and the vibration direction of the piezoelectric element have heretofore been the same. When a predetermined voltage is applied to the piezoelectric element in this constitution, the piezoelectric element expands/contracts. Accordingly, the piezoelectric element and vibration plate cause a drum-shaped vibration, the liquid in the pressure chamber is compressed, and the droplets are accordingly discharged from a liquid discharge port. Therefore, this method using the piezoelectric element does not have volume fluctuation of the flied droplets by the heat accumulated in the liquid jet head or an adverse influence of the cavitation by the debubbling onto the electrothermal conversion element. However, there is a problem that it is difficult to manufacture the liquid jet head with good precision or to integrate the nozzles.

At present, with the spread of the liquid jet apparatus, there has been a demand for enhancement of printing capability, especially a high reliquid and high-speed printing. Therefore, the liquid jet head has been miniaturized and a multi nozzle head structure has been used to make an attempt to realize the high reliquid and high-speed printing.

In the method using the electrothermal conversion element, it is easy to miniaturize/process the head. Moreover, there has similarly been a strong demand for miniaturization of the head of the piezoelectric element by the fine processing of the head. For the miniaturization of the piezoelectric element, a method of reducing the thickness of a piezoelectric material, using the vibration plate to generate deflection vibration, and discharging the liquid is structurally possible. However, displacement of the piezoelectric material itself with respect to the voltage is very small. Therefore, when the piezoelectric element is miniaturized, sufficient stress or vibration is not generated from the drop of a piezoelectric property and the liquid cannot be discharged. Then, in order to realize the high reliquid and high-speed recording including the small-sized multi nozzle head, attempts have been made to develop a piezoelectric thin film material which has a sufficient piezoelectric property even in a small film thickness and to establish the manufacturing method.

Especially, in the piezoelectric material of a sintered material which has heretofore been used, the device has been miniaturized by mechanical processing such as cutting. However, there is a limitation in the miniaturization by the mechanical processing, deterioration of the piezoelectric property is caused, and it has been difficult to establish both the miniaturization and the high reliquid.

On the other hand, to solve the problem of the piezoelectric element including a conventional sintered material, in Japanese Patent Application Laid-Open No. 10-286953, a constitution and manufacturing method have been proposed in which the thickness of the piezoelectric material or the vibration plate constituting the piezoelectric element is reduced so as to obtain such a shape that the fine processing generally used in a semiconductor process is possible. Furthermore, a thin film material having a large piezoelectric characteristic even with the small film thickness is developed, and a high-density structure of the nozzles is realized.

However, according to the manufacturing process proposed in the Japanese Patent Application Laid-Open No. 10-286953, the thickness of the piezoelectric material or the vibration plate constituting the piezoelectric element is reduced, and the semiconductor process is used to perform the fine processing. However, any concrete manufacturing method has not been disclosed with respect to the forming of the liquid jet head which is a device.

In the liquid jet head, in order to realize the miniaturization, the high reliquid including the multi nozzle head, and high-speed recording, it has been an important problem to prepare a structure in which not only the piezoelectric element but also the nozzle structure, pressure chamber, and liquid supply path can be optimized/designed and the droplets can be controlled with good precision.

SUMMARY OF THE INVENTION

One of objects of the present invention is to provide a manufacturing method of a liquid jet head in which a thickness of a piezoelectric material or vibration plate is reduced and accordingly a semiconductor process can be used to carry out fine processing, a nozzle structure, liquid flow paths such as a pressure chamber, and a piezoelectric element can be prepared with good precision, a multi nozzle structure can easily be realized, and additionally droplet discharge can be controlled with good precision.

According to one aspect of the present invention, there is provided a manufacturing method of a liquid jet head, comprising: a step of forming a piezoelectric member which generates a discharge pressure for discharging a liquid on a substrate; a step of disposing a vibration plate on the piezoelectric member; a step of forming a liquid flow path pattern containing a soluble resin on the vibration plate; a step of forming a coat layer containing a resin constituting a wall of the liquid flow path on the liquid flow path pattern; a step of removing the liquid flow path pattern to form the liquid flow path; a step of removing the substrate; and a step of patterning the piezoelectric member in accordance with the liquid flow path.

According to another aspect of the present invention, there is provided a manufacturing method of a liquid jet head comprising: a step of forming a piezoelectric member which generates a discharge pressure for discharging a liquid on a substrate; a step of disposing a vibration plate on the piezoelectric member; a step of forming a liquid flow path pattern containing a soluble resin on the vibration plate; a step of forming a coat layer containing a resin constituting a wall of the liquid flow path on the liquid flow path pattern; a step of removing the substrate; a step of patterning the piezoelectric member in accordance with the liquid flow path; and a step of removing the liquid flow path pattern to form the liquid flow path.

According to the present invention, the thickness of the piezoelectric material or the vibration plate is reduced so that a semiconductor process can be used to carry out fine processing. Moreover, individual position precisions of a nozzle structure, a liquid flow path such as a pressure chamber, and a piezoelectric element can be enhanced, and these designs can be optimized. Furthermore, a multi nozzle structure can easily be realized, and the droplet discharge can be controlled with good precision. The liquid jet head can be prepared in which miniaturization, high reliquid, and high-speed recording are possible.

DESCRIPTION OF THE PREFERRED EMBODIMENTS

Embodiments of the present invention will be described hereinafter with reference to the drawings.

Figure 1:
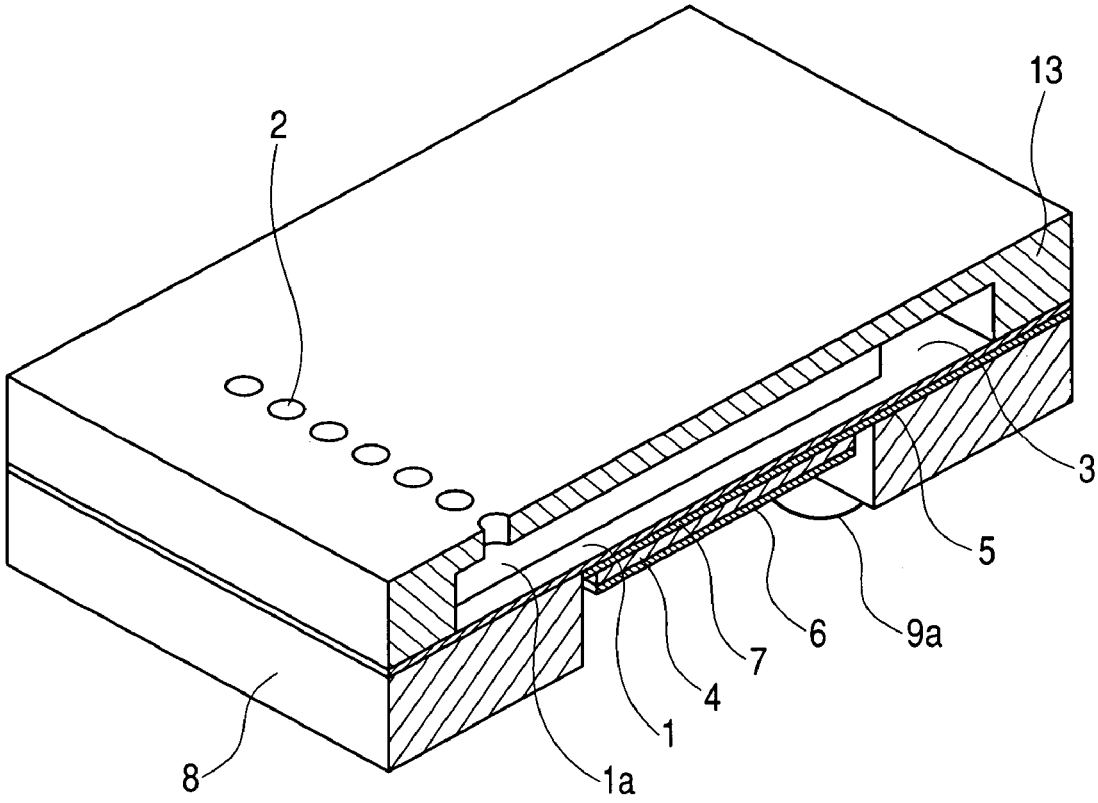
FIG. 1 is a perspective view showing a liquid jet head prepared by a manufacturing method of the liquid jet head according to the present invention in a partially broken state seen from a liquid discharge direction.
Figure 2:
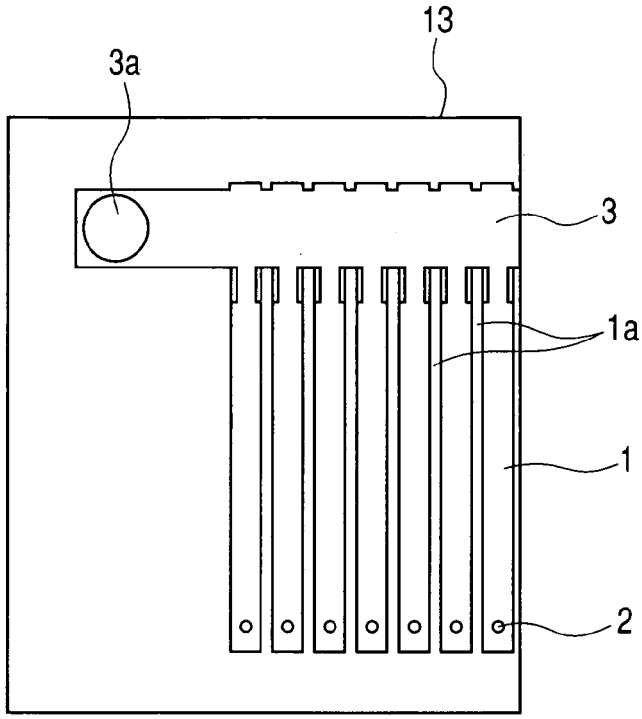
FIG. 2 is a partial schematic view of a pressure chamber or a liquid flow path such as a liquid supply path in the liquid jet head shown in FIG. 1 seen from a back surface side.
Figure 3:
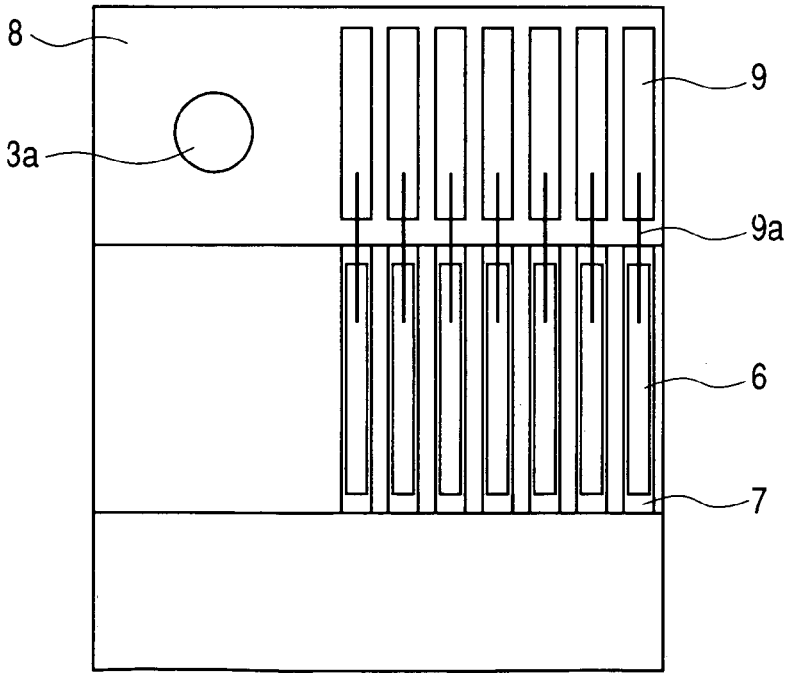
FIG. 3 is a partial schematic view of the liquid jet head shown in FIG. 1 seen from the back surface side.

FIG. 1 is a perspective view showing a liquid jet head prepared by a manufacturing method of the liquid jet head according to the present invention in a partially broken state seen from a liquid discharge direction. FIG. 2 is a partial schematic view of a pressure chamber or a liquid flow path such as a liquid supply path in the liquid jet head shown in FIG. 1 seen from a back surface side. FIG. 3 is a partial schematic view of the liquid jet head shown in FIG. 1 seen from the back surface side.

As shown in FIGS. 1 to 3, the liquid jet head prepared by the manufacturing method of the liquid jet head according to the present invention includes: pressure chambers 1 in which a liquid is contained; liquid discharge ports 2 for discharging the liquid; piezoelectric members 4, communicated with the liquid discharge ports 2, for applying a pressure to the pressure chambers 1; and a vibration plate 5 such as a metal, ceramic, and resin which vibrates by the piezoelectric members 4. The pressure chambers 1 are separated from one another by partition walls 1*a*, a plurality of chambers are juxtaposed and constituted in a lateral direction, and the same number of liquid discharge ports 2 and piezoelectric members 4 as that of pressure chambers 1 are similarly juxtaposed/constituted.

The pressure chamber 1 is communicated with a liquid supply path 3 to form a liquid flow path for feeding a liquid to the liquid discharge port 2 together with the liquid supply path 3. Liquid flow path walls such as the partition walls 1*a* which define the pressure chambers 1 are constituted of organic polymer materials (coat resins) described later, and the vibration plate 5 is bonded to one surface of the pressure chamber 1. The piezoelectric member 4 is formed in the vibration plate 5, and a signal electrode 6 and common electrode 7 for sending signals to each piezoelectric member 4 are disposed on opposite surfaces of the piezoelectric member 4, respectively. As shown in FIG. 3, the signal electrodes 6 are formed opposite to the respective piezoelectric members 4, and signal lines 9 disposed opposite to the signal electrodes 6 are patterned in a base substrate 8, and disposed so as to easily contact flexible signal lines from the outside. The signal lines 9 are wire-bonded and communicated with the respective signal electrodes 6 on the piezoelectric members 4 via Au wires 9*a*.

A liquid supply port 3*a* is communicated with the liquid supply path 3 through the base substrate 8 from a back surface side, and is designed so that the liquid can be fed to each pressure chamber 1.

Here, as the piezoelectric member 4 constituting the piezoelectric element, a lead-containing dielectric thin film is effective from a superior piezoelectric property, and has a sufficient piezoelectric characteristic even in a film thickness of 20 $\mu$m or less. When the thickness of the piezoelectric member is set to 20 $\mu$m or less, the piezoelectric member can be formed by a thin film process, and the fine processing can also be carried out. Therefore, the piezoelectric element can be processed even with a width of about 10 $\mu$m. Accordingly, the liquid discharge ports 2 can be arranged with micro pitch widths in one row, printing reliquid is enhanced, and further printing speed can be enhanced.

Next, the manufacturing method of the liquid jet head of the present invention will be described with reference to FIGS. 4A to 4L. FIGS. 4A to 4L show schematic step diagrams showing major steps of the manufacturing method of the liquid jet head according to the present invention in sections.

Figure 4A:
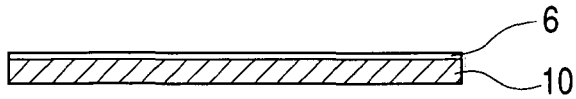
FIGS. 4A, 4B, 4C, 4D, 4E, 4F, 4G, 4H, 4I, 4J, 4K and 4L show schematic step diagrams showing major steps of the manufacturing method of the liquid jet head according to the present invention in sections.
Figure 4B:
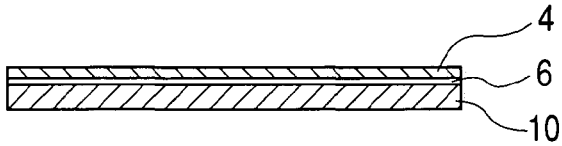
Figure 4C:
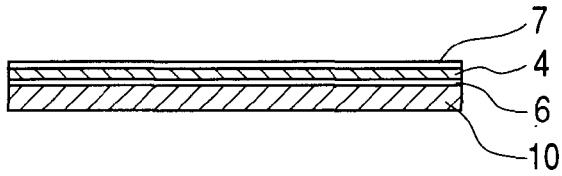

In FIGS. 4A to 4C, a Pt layer forming the signal electrode 6 is formed on an MgO substrate 10 (FIG. 4A), a lead-based dielectric material which is a thin film piezoelectric member constituting the piezoelectric member 4 is rf-sputtered and formed on the signal electrode 6 (FIG. 4B), and subsequently an Au layer constituting the common electrode 7 is formed on the piezoelectric member 4 (FIG. 4C). It is to be noted that MgO is used as the substrate 10, but the material is not limited to MgO, and an oxide film may be formed in an Si substrate, or metal oxide films such as MgO can also be laminated/deposited. A lead-based dielectric material which is the piezoelectric member 4 can obtain satisfactory piezoelectric property with an oriented film or monocrystal film oriented in a c-axis direction of a PZT base having a film thickness of 3 $\mu$m. For a method of forming the lead-based dielectric material, in addition to an rf sputtering method, even in a spin coat method in which MOCVD or sol gel liquid is used, a piezoelectric thin film having a satisfactory crystal property can be formed.

Figure 4D:
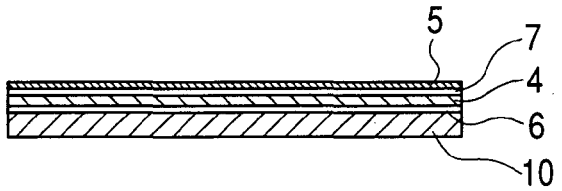

Next, as shown in FIG. 4D, the vibration plate 5 is formed of a metal material, ceramic material, or organic resin on the common electrode 7 formed on the piezoelectric member 4. For the forming of the vibration plate 5, the vibration plate was formed by a spin coat method, but can also be formed by coating a film such as PET with an organic resin dissolved in a solvent. The film is then dried to prepare a dry film, and can accordingly be laminated (stacked) and formed on the common electrode 7. Even when the material is not formed of the resin, metals or metal oxides such as Cr, Ni, $SiO_2$, $ZrO_2$ may be laminated using sputtering, vapor deposition, coating method, or sol gel method. A multilayered laminate structure with the resin may also be used.

Figure 4E:
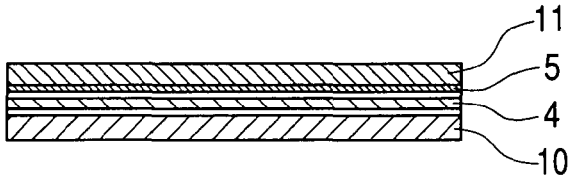
Figure 4F:
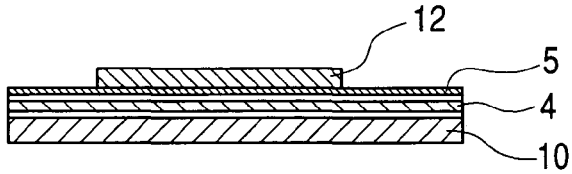

Next, as shown in FIGS. 4E to 4F, a pattern resin layer 12 is formed by a soluble resin of a liquid flow path constituting the pressure chamber 1 shown in FIG. 2 and the liquid supply path 3 communicated with the pressure chamber 1 on the vibration plate 5. That is, the vibration plate 5 is coated with a soluble resin material layer 11 (FIG. 4E), the liquid flow path constituting the pressure chamber 1 and liquid supply path 3 is patterned, and a liquid flow path pattern is formed (FIG. 4F). Examples of most general means include means for forming the pattern in a photosensitive organic material. When the photosensitive organic material is used, the pattern resin layer 12 of the liquid flow path is soluble, and it is therefore possible to use a positive resist or a negative resist of a solubility change type. As a preferable forming method of the resist layer, a photosensitive material is dissolved in an appropriate solvent, the film such as PET is coated and dried to form the dry film, and the film is laminated and accordingly formed. As another coat method, it is possible to form the layer by means such as a spin coat and screen printing method. For the dry film, vinyl ketone based photo-degradation polymer compounds such as polymethyl isopropyl ketone and polyvinyl ketone can preferably be used.

Figure 4G:
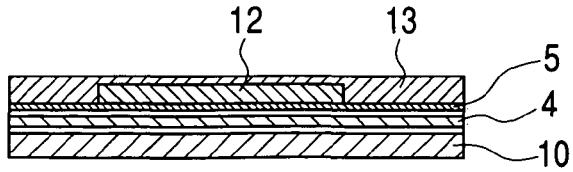

Thereafter, as shown in FIG. 4G, a coat resin layer 13 is further formed on the soluble pattern resin layer 12 which is the liquid flow path pattern by a usual spin coat, cast coat, or roll coat method.

Here, in a step of forming the coat resin layer 13, characteristics are required such that the soluble pattern resin layer 12 is not deformed. That is, the coat resin is dissolved in the solvent, and this is formed on the soluble pattern resin layer 12 by the spin coat or roll coat. In this case, the solvent needs to be selected so as to prevent the soluble pattern resin layer 12 from being dissolved. The coat resin is preferably photosensitive so that the liquid discharge port 2 can easily and precisely be formed by photolithography. This photosensitive coat resin layer 13 is requested to have a high mechanical strength as a structure material, adhesion to the vibration plate 5, ink resistance, and reliquid for patterning a fine pattern of the liquid discharge port 2. For this, cation polymerized hardened material of an epoxy resin has superior strength, adhesion, and resistance to ink as the structure material. Moreover, when the epoxy resin is solid at normal temperature, the material has further superior patterning characteristics.

The cation polymerized hardened material of the epoxy resin has a high crosslinking density (high Tg) as compared with usual acid anhydride or the hardened material by amine, and therefore exhibits superior characteristics as the structure material. With the use of the epoxy resin which is solid at normal temperature, a polymerization initiating seed generated from a cation polymerization initiator by light irradiation is inhibited from being diffused in the epoxy resin, and superior patterning precision and shape can be obtained.

As a method of forming the coat resin layer 13 on the soluble pattern resin layer 12, it is preferable to dissolve the coat resin which is solid at normal temperature in the solvent and form the layer by the spin coat method. With the use of the spin coat method which is a thin film coating technique, the coat resin layer 13 can uniformly and precisely be formed. Examples of the solid epoxy resin for use in the present invention include: a reactant having a molecular weight of about 900 or more in reactants of bisphenol A with epichlorohydrin; a reactant of bromphenol A with epichlorohydrin; a reactant of phenol novolak or o-cresol novolak with epichlorohydrin; and a polyfunctional epoxy resin including an oxycyclohexane framework described in Japanese Patent Application Laid-Open Nos. 60-161973, 63-221121, 64-9216, and 2-140219. Needless to say, the present invention is not limited to these compounds.

Moreover, in the above-described epoxy compounds, a compound having an epoxy equivalent weight of preferably 2000 or less, more preferably 1000 or less is preferably used. This is because if the epoxy equivalent weight exceeds 2000, a crosslinking density at a hardening reaction time drops, Tg or thermal deformation temperature of the hardened material drops, and a problem is sometimes generated in the adhesion and the resistance to ink.

Examples of the photo cation polymerization initiator for hardening the epoxy resin include: aromatic iodonium salt, aromatic sulfonium salt [see J. POLYMER SCI: Symposium No. 56 pp. 383 to 395 (1976)]; and SP-150, SP-170 marketed from Asahi Denka Kogyo K.K. For the photo cation polymerization initiator, when a reducer is also used and heated, cation polymerization can be promoted (the crosslinking density is enhanced as compared with the photo cation polymerization alone). Additionally, when both the photo cation polymerization initiator and reducer are used, the reducer needs to be selected so as to have a so-called oxidation-reduction initiator system which does not react at normal temperature and reacts at a constant or higher temperature (preferably 60° C. or more). As the reducer, in consideration of a copper compound, especially reactivity and solubility to the epoxy resin, copper triflate (trifluoromethane copper sulfonate (II)) is optimum. The reducers such as ascorbic acid are also useful. When a higher crosslinking density (high Tg) is necessary as in the increase of the number of nozzles (high-speed printing property) and use of non-neutral ink (improvement of resistance to water of a colorant), the crosslinking density can be raised in a post-process. In the process, the reducer is used in the form of a liquid after a development step of the coat resin layer as described later, and the coat resin layer is immersed and heated. Furthermore, it is possible to appropriately add an additive to the composition if necessary. For example, a flexibility imparting agent is added for a purpose of lowering elasticity of the epoxy resin, or a silane coupling agent is added in order to obtain a further adhesion to the substrate.

Figure 4H:
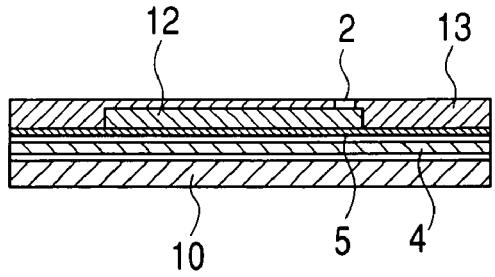

Next, as shown in FIG. 4H, the liquid discharge port 2 is formed with respect to the photosensitive coat resin layer 13 formed of the above-described compound. For this, first the pattern is exposed via a mask. The photosensitive coat resin layer 13 of the present embodiment is negative, and a portion in which the liquid discharge port 2 is to be formed is shielded with the mask. For the pattern exposure, an ultraviolet ray, deep-UV light, electron beam, X-ray, and the like can appropriately be selected in accordance with a photosensitive region of the photo cation polymerization initiator for use.

In the above-described steps, the positioning is possible using all conventional photolithography techniques. As compared with a conventional method of separately preparing an orifice plate and bonding the plate to the substrate, the precision can remarkably be raised. The pattern-exposed photosensitive coat resin layer 13 may also be subjected to a heating treatment in order to promote the reaction if necessary. Here, as described above, the photosensitive coat resin is constituted of the epoxy resin which is solid at normal temperature. Therefore, the diffusion of the cation polymerization initiating seed generated in the pattern exposure is restricted, and superior pattern precision and shape can be realized.

Next, the pattern-exposed photosensitive coat resin layer 13 is developed using an appropriate solvent, and the liquid discharge port 2 is formed as shown in FIG. 4H. Here, simultaneously with the development of the unexposed photosensitive coat resin layer 13, it is also possible to form the soluble pattern resin layer 12 forming the liquid flow path. Additionally, in general, a plurality of heads having the same mode or different modes are disposed on the substrate 10, and used as the liquid jet heads through a cutting step. Therefore, the pattern resin layer 12 forming the liquid flow path is left (since the pattern resin layer 12 is left, dust generated at a cutting time does not enter the liquid flow path). It is also possible to develop the pattern resin layer 12 after the cutting step. At this time, scum (development residue) generated at the time of the development of the photosensitive coat resin layer 13 is eluted together with the soluble pattern resin layer 12, and therefore the residue is not left in the nozzle.

When the crosslinking density needs to be raised as described above, thereafter the photosensitive coat resin layer 13 in which the liquid flow path (1, 3) and liquid discharge port 2 are formed are formed is immersed in a soluble containing the reducer and heated to perform post hardening. Accordingly, the crosslinking density of the photosensitive coat resin layer is further raised, and the adhesion to the vibration plate 5 and the resistance to ink are very satisfactory. Needless to say, the immersing/heating step in the reducer-containing liquid may also be carried out immediately after pattern-exposing and developing the photosensitive coat resin layer 13 to form the liquid discharge port 2 without any problem. Thereafter, the soluble pattern resin layer 12 may be eluted. For the immersing and heating step, the heating may also be carried out during the immersing, and the heating treatment may also be carried out after the immersing. As the reducer, any material having a reducing function is useful, and especially compounds containing copper ions such as copper triflate, copper acetate, and copper benzoate are effective. Among the compounds, especially copper triflate exhibits a very high effect. Additionally, ascorbic acid is also useful.

Figure 4I:
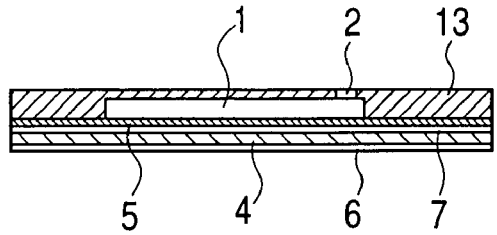

Next, as shown in FIG. 4I, the MgO substrate 19 is etched/removed in an acidic solution. When a phosphoric liquid is used as the acidic solution, MgO can stably be dissolved without damaging the piezoelectric member 4.

Figure 4J:
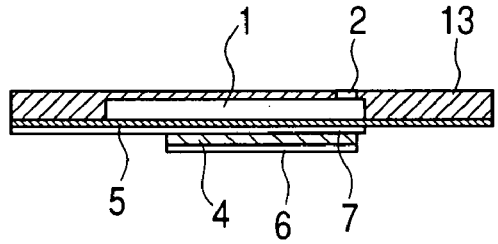
Figure 4K:
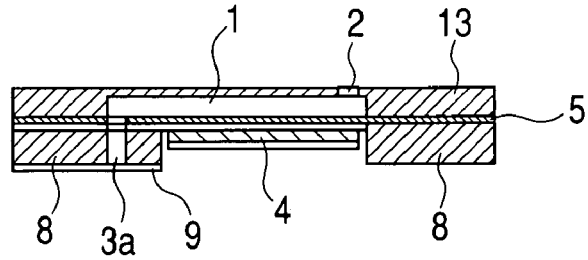
Figure 4L:
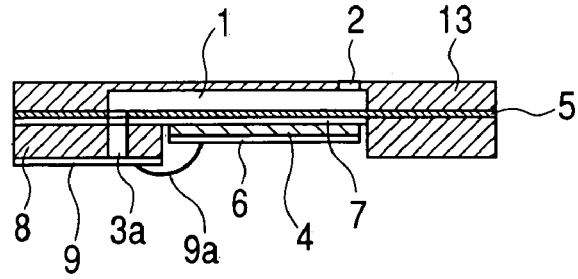
Figure 5A:
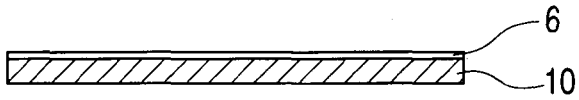
FIGS. 5A, 5B, 5C, 5D, 5E, 5F, 5G, 5H, 5I, 5J, 5K and 5L show schematic step diagrams showing the major steps of another concrete manufacturing method of the liquid jet head according to the present invention in the sections.
Figure 5B:
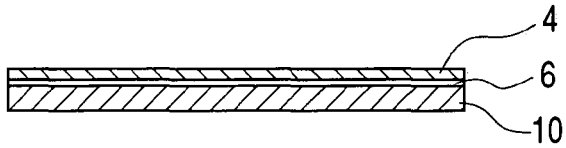
Figure 5C:
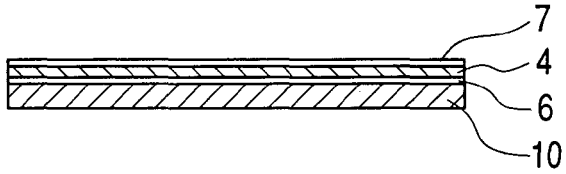
Figure 5D:
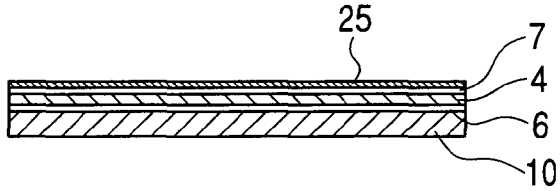
Figure 5E:
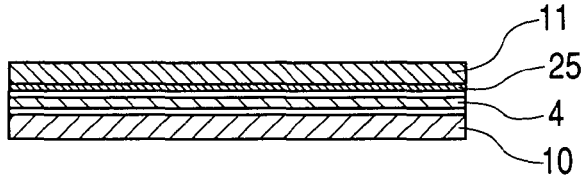
Figure 5F:
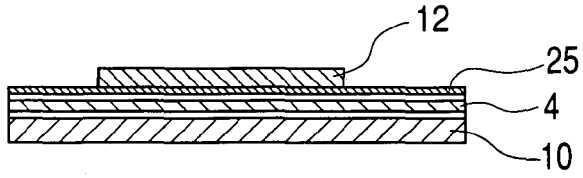
Figure 5G:
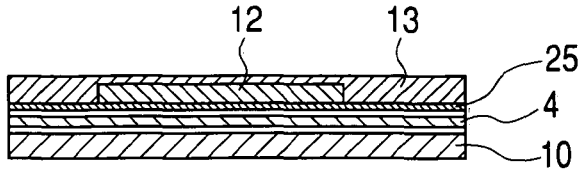
Figure 5H:
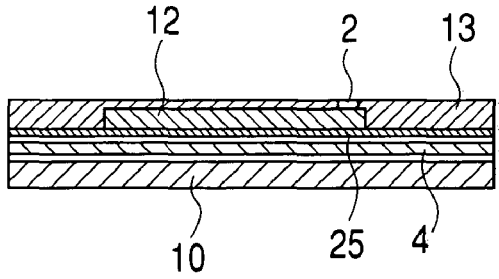
Figure 5I:
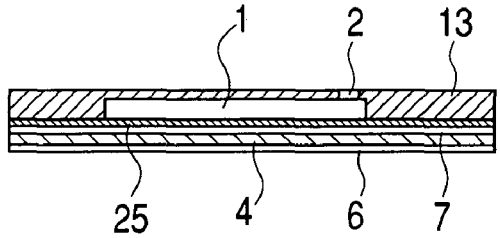
Figure 5J:
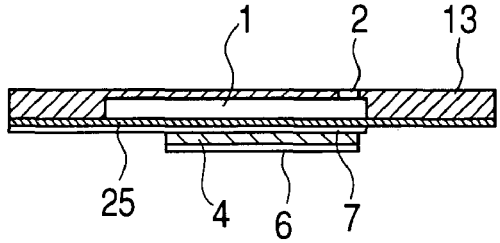
Figure 5K:
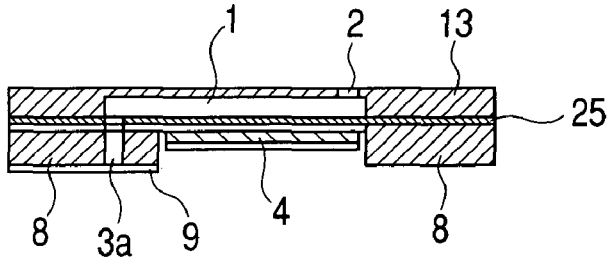
Figure 5L:
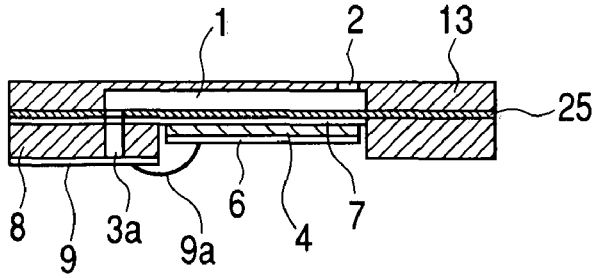

The piezoelectric member 4 obtained by a thin film process such as sputtering is formed on the MgO substrate 10. Finally, the MgO substrate 10 is removed, the resist pattern is formed, and the pattern is removed by the acidic solution (FIG. 4J). Moreover, the base substrate 8 in which the liquid supply port 3*a* is formed is bonded and the liquid supply port 3*a* is communicated with the liquid flow path (FIG. 4K). The signal lines 9 formed in the base substrate 8 are wire-bonded to the signal electrodes 6 of the piezoelectric members 4 via the Au wires 9*a* (FIG. 4L). In the forming of the liquid supply port 3*a*, any method can be used as long as the method is means which can form holes in the base substrate 8. For example, the port may also be formed using mechanical means such as a drill or light energies such as laser. The port may also be chemically etched.

With respect to the liquid supply path 3 and pressure chamber 1 constituting the liquid flow path in this-manner, and the base substrate 8 in which the liquid discharge port 2 and piezoelectric element are formed, the liquid supply member for supplying the liquid into the liquid supply port 3*a* is bonded, and electric bonding for driving the piezoelectric element is carried out. Accordingly, the liquid jet head is prepared.

It is to be noted that in the present embodiment, the liquid discharge port 2 is formed by photolithography, but the present invention is not limited to this. When the mask is changed, the liquid discharge port can also be formed by dry etching by oxygen plasma or excimer laser. When the liquid discharge port is formed by the dry etching or excimer laser, the substrate is protected by the resin pattern and prevented from being damaged by the plasma or laser. Therefore, it is possible to provide a head high in precision and reliability. Furthermore, when the liquid discharge port is formed by the dry etching or excimer laser, a heat setting resin can also be applied as the coat resin in addition to the photosensitive resin.

The liquid jet head of the present invention prepared as described above is effective as the liquid jet head of a full line type which can simultaneously carry out the recording over the whole width of a recording sheet. Furthermore, the present invention is also effective for a color recording head in which the liquid jet head is integrally formed or a plurality of heads are combined. Moreover, the present invention can also be applied to a solid ink which is liquefied at a certain or higher temperature.

Figure 6A:
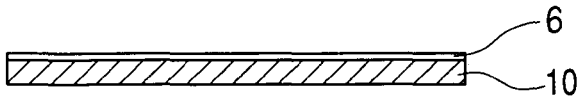
FIGS. 6A, 6B, 6C, 6D, 6E, 6F, 6G, 6H, 6I, 6J, 6K and 6L show sectional step diagrams schematically showing the manufacturing steps according to another embodiment of the present invention.
Figure 6B:
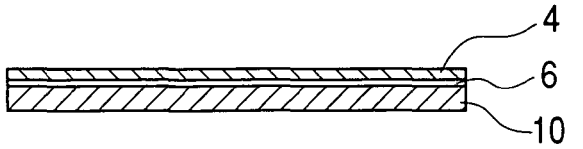
Figure 6C:
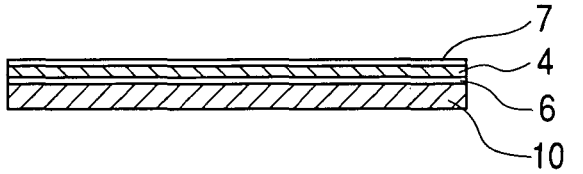
Figure 6D:
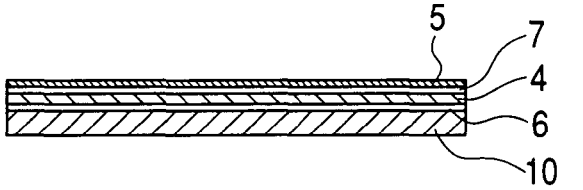
Figure 6E:
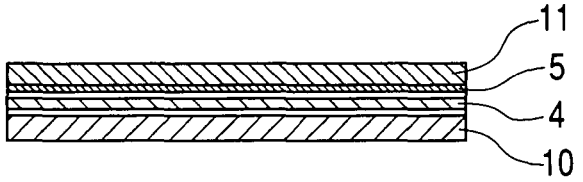
Figure 6F:
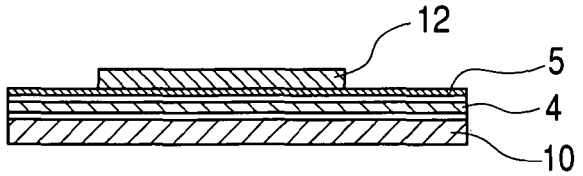
Figure 6G:
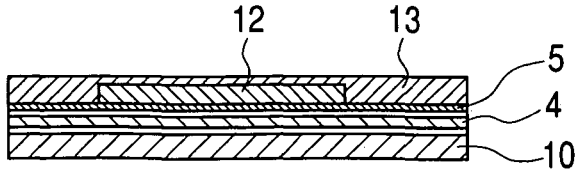
Figure 6H:
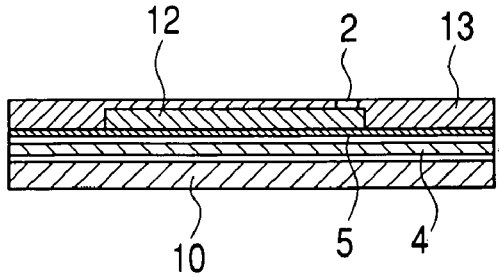
Figure 6I:
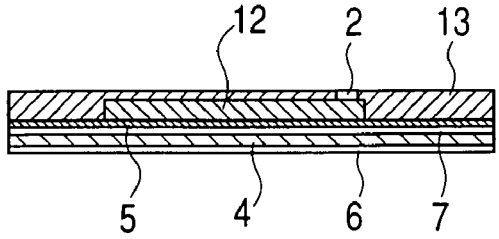
Figure 6J:
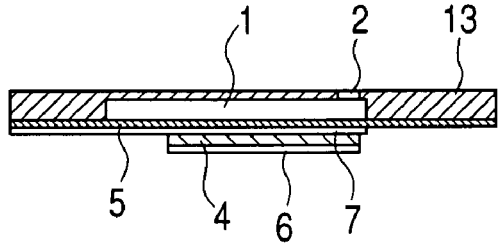
Figure 6K:
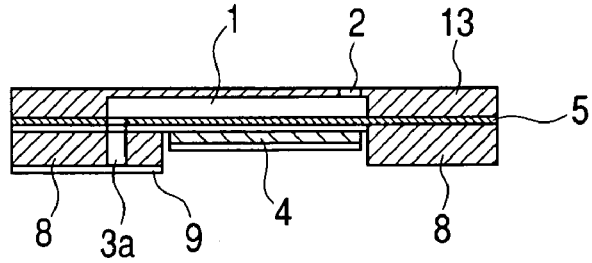
Figure 6L:
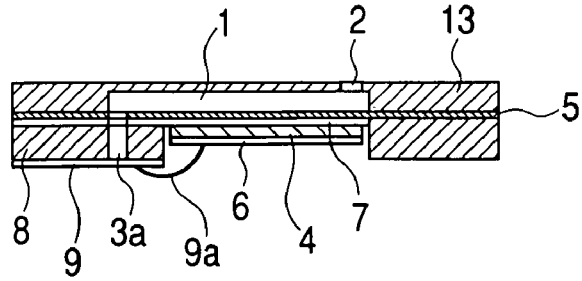

FIGS. 6A to 6L show sectional step diagrams schematically showing the manufacturing steps according to another embodiment of the present invention. Differences from the embodiment of FIGS. 4A to 4L lie in that the pattern resin layer 12 is removed after patterning the piezoelectric member 4 (FIG. 6J). In the present embodiment, the highly precise liquid flow path is formed by the removal of the pattern resin layer 12 relatively later in the flow of the manufacturing steps. Therefore, a possibility of invasion of foreign particles into the liquid flow path is reduced, and the reliability of the head is preferably further enhanced.

EXAMPLE 1

Next, a concrete example in the manufacturing method of the liquid jet head according to the present invention will be described following a step procedure shown in FIGS. 4A to 4L.

First, the Pt layer forming the signal electrode 6 was formed on a (100) plane of the MgO substrate 10, and a PZT-based dielectric layer (piezoelectric member 4) having a film thickness of 3 μm was rf-sputtered and formed as the piezoelectric material on the signal electrode 6. Next, the Au layer constituting the common electrode 7 was formed on the PZT-based dielectric layer (piezoelectric member 4).

Subsequently, the following vibration plate 5 was formed on the common electrode 7.

An epoxy resin (o-cresol novolak type epoxy resin) 100 parts;

a photo cation polymerization initiator (4,4-di-t-butylphenyl iodonium hexafluoroantimonate) 1 part;

a silane coupling agent (A-187 manufactured by Nihon Yunika Co.) 10 parts; and silica particles 5 parts.

A resin composition constituted of the above was dispersed/dissolved in a methyl isobutyl ketone/xylene mixture liquid at a concentration of 20 wt %. By the spin coat, the composition was applied in a thickness of 2 μm, and exposed in PLA520 (CM250) in order to cure the vibration plate 5. It is to be noted that the exposure was carried out for 10 seconds, after-baking was carried out at 60° C. for 30 minutes, and the vibration plate 5 was formed. The vibration plate 5 has a function of amplifying vibration, when the piezoelectric member 4 disposed opposite to the signal electrode 6 vibrates. When the thickness of the vibration plate 5 in contact with the common electrode 7 was 2 μm, satisfactory vibration characteristics were obtained.

Next, in order to form the liquid flow path constituted of the pressure chamber 1 and liquid supply path 3, as the soluble resin material layer 11, PET was coated with polymethyl isopropenyl ketone (ODUR-1010 manufactured by Tokyo Ohka Kogyo Co., Ltd.) and dried to form a dry film. The film was laminated and accordingly transferred. It is to be noted that ODUR-1010 has low viscosity and cannot be formed into a thick film, and was therefore condensed and used.

Next, after pre-baking at 120° C. for 20 minutes, the pattern of the liquid flow path was exposed by a mask aligner PLA520 (cold mirror CM290) manufactured by Cannon Inc. The exposure was carried out for 1.5 minutes, methyl isobutyl ketone/xylene=2/1 was used for development, and xylene was used for rinse. The pattern resin layer 12 formed of the soluble resin is formed in order to secure the liquid flow path between the liquid supply port 3*a* and piezoelectric member 4. It is to be noted that the film thickness of the resist after the development was 10 μm.

Next, the resin composition containing:

the epoxy resin (o-cresol novolak type epoxy resin) 100 parts;

the photo cation polymerization initiator (4,4-di-t-butylphenyl iodonium hexafluoroantimonate) 1 part;

the silane coupling agent (A-187 manufactured by Nihon Yunika Co.) 10 parts; and the silica particles 5 parts was dispersed/dissolved in the methyl isobutyl ketone/xylene mixture solvent at the concentration of 20 wt %. By the spin coat, the photosensitive coat resin layer 13 was formed. At this time, the film thickness on the soluble liquid flow path pattern was 10 μm.

Thereafter, the pattern was exposed in the PLA520 (CM250) in order to form the liquid discharge port. It is to be noted that the exposure was carried out for 10 seconds, and the after-baking was carried out at 60° C. for 30 minutes. Subsequently, the development was carried out by methyl isobutyl ketone to form the liquid discharge port 2. It is to be noted that in the present example, a discharge port pattern of ϕ30 μm was formed.

Moreover, in the above-described condition, the pattern resin layer 12 of the liquid flow path is not completely developed and left. A plurality of heads having the same mode or different modes are usually arranged on the MgO substrate 10. Therefore, in this stage, the head is cut by a dicer, and the like, and the individual liquid jet heads are obtained. However, here, since the soluble pattern resin layer 12 is left as described above, the dust generated at the cutting time can be prevented from entering the head. The liquid jet head obtained in this manner was exposed again in the PLA520 (CM250) for two minutes. An ultrasonic wave was applied into methyl isobutyl ketone while immersing the head, and the left pattern resin layer 12 of the liquid flow path was eluted.

Next, the liquid jet head was heated at 150° C. for one hour to completely cure the photosensitive coat resin layer 13, and the MgO substrate 10 was etched/removed by the acidic solution. The signal electrode 6 is patterned after etching/removing the MgO substrate 10. After etching the MgO substrate 10, the piezoelectric member 4 was patterned using a strongly acidic solution so as to obtain a shape divided in accordance with each pressure chamber 1. Moreover, the base substrate 8 in which the liquid supply port 3*a* is formed is attached, and the signal electrodes 6 are wire-bonded to the signal lines 9 via the Au wires 9*a*.

Finally, the liquid supply member was bonded to the liquid supply port 3*a*, the electric bonding for driving the piezoelectric element was carried out, and the liquid jet head was completed.

The liquid jet head prepared in this manner was mounted on a liquid jet apparatus, and ink containing pure water/diethylene glycol/isopropyl alcohol/lithium acetate/black dyestuff food black 2=79.4/15/3/0.1/2.5 was used to perform the recording. Then, stable printing was possible, and an obtained printed matter was of a high grade.

EXAMPLE 2

Next, another concrete example in the manufacturing method of the liquid jet head according to the present invention will be described following the step procedure shown in FIGS. 5A to 5L. It is to be noted that FIGS. 5A to 5L show schematic step diagrams similar to those of FIGS. 4A to 4L. FIGS. 5A to 5L are similar to FIGS. 4A to 4L except that a vibration plate 25 including a two-layer structure of an $SiO_2$ film and resin is used instead of the vibration plate 5 formed of the resin, and therefore the same reference numerals are shown.

First, the Pt layer forming the signal electrode 6 was formed on the (100) plane of the MgO substrate 10, and the PZT-based dielectric layer (piezoelectric member 4) having a film thickness of 5 μm was rf-sputtered and formed as the piezoelectric material on the signal electrode 6. Next, the Au layer constituting the common electrode 7 was formed on the PZT-based dielectric layer (piezoelectric member 4).

Subsequently, the following vibration plate 25 was formed on the common electrode 7.

First, $SiO_2$ was formed in about 2 μm by the rf sputtering. Thereafter, the resin composition containing:

the epoxy resin (o-cresol novolak type epoxy resin) 100 parts;

the photo cation polymerization initiator (4,4-di-t-butylphenyl iodonium hexafluoroantimonate) 1 part;

the silane coupling agent (A-187 manufactured by Nihon Yunika Co.) 10 parts; and the silica particles 5 parts was dispersed/dissolved in the methyl isobutyl ketone/xylene mixture liquid at the concentration of 50 wt %. By the spin coat, the composition was applied in 1 μm, and exposed in PLA520 (CM250) in order to cure the vibration plate 25. It is to be noted that the exposure was carried out for 10 seconds, the after-baking was carried out at 60° C. for 30 minutes, and the vibration plate 25 was formed. The vibration plate 25 has the function of amplifying the vibration, when the piezoelectric member 4 disposed opposite to the signal electrode 6 vibrates. When the thickness of the vibration plate 25 in contact with the common electrode 7 was 3 μm, the satisfactory vibration characteristics were obtained.

Next, in order to form the liquid flow path constituted of the pressure chamber 1 and liquid supply path 3, as the soluble resin material layer 11, PET was coated with polymethyl isopropenyl ketone (ODUR-1010 manufactured by Tokyo Ohka Kogyo Co., Ltd.) and dried to form the dry film. The film was laminated and accordingly transferred. It is to be noted that ODUR-1010 has low viscosity and cannot be formed into a thick film, and was therefore condensed and used.

Next, after the pre-baking at 120° C. for 20 minutes, the pattern of the liquid flow path was exposed by the mask aligner PLA520 (cold mirror CM290) manufactured by Cannon Inc. The exposure was carried out for three minutes, methyl isobutyl ketone/xylene=2/1 was used for the development, and xylene was used for the rinse. The pattern resin layer 12 formed of the soluble resin is formed in order to secure the liquid flow path between the liquid supply port 3*a* and piezoelectric member 4. It is to be noted that the film thickness of the resist after the development was 50 μm.

Subsequently, the resin composition containing:

the epoxy resin (o-cresol novolak type epoxy resin) 100 parts;

the photo cation polymerization initiator (4,4-di-t-butylphenyl iodonium hexafluoroantimonate) 1 part;

the silane coupling agent (A-187 manufactured by Nihon Yunika Co.) 10 parts; and the silica particles 5 parts was dispersed/dissolved in the methyl isobutyl ketone/xylene mixture solvent at the concentration of 20 wt %. By the spin coat, the photosensitive coat resin layer 13 was formed. At this time, the film thickness on the soluble liquid flow path pattern was 30 μm.

Thereafter, the pattern was exposed in the PLA520 (CM250) in order to form the liquid discharge port. It is to be noted that the exposure was carried out for 20 seconds, and the after-baking was carried out at 60° C. for 45 minutes. Subsequently, the development was carried out by methyl isobutyl ketone to form the liquid discharge port 2. It is to be noted that in the present example, the discharge port pattern of ϕ30 μm was formed.

Moreover, in the above-described condition, the pattern resin layer 12 of the liquid flow path is not completely developed and left. A plurality of heads having the same mode or different modes are usually arranged on the MgO substrate 10. Therefore, in this stage, the head is cut by the dicer, and the like, and the individual liquid jet heads are obtained. However, here, since the soluble pattern resin layer 12 is left as described above, the dust generated at the cutting time can be prevented from entering the head. The liquid jet head obtained in this manner was exposed again in the PLA520 (CM250) for two minutes. The ultrasonic wave was applied into methyl isobutyl ketone while immersing the head, and the left pattern resin layer 12 of the liquid flow path was eluted.

Next, the liquid jet head was heated at 150° C. for one hour to completely cure the photosensitive coat resin, and the MgO substrate 10 was etched/removed by the acidic solution. The signal electrode 6 is patterned after etching/removing the MgO substrate 10. After etching the MgO substrate 10, the piezoelectric member 4 was patterned using the strongly acidic solution so as to obtain the shape divided in accordance with each pressure chamber 1. Moreover, the base substrate 8 in which the liquid supply port 3*a* is formed is attached, and the signal electrodes 6 are wire-bonded to the signal lines 9 via the Au wires 9*a*.

Finally, the liquid supply member was bonded to the liquid supply port 3*a*, the electric bonding for driving the piezoelectric element was carried out, and the liquid jet head was completed.

The liquid jet head prepared in this manner was mounted on the liquid jet apparatus, and ink containing pure water/diethylene glycol/isopropyl alcohol/lithium acetate/black dyestuff food black 2=79.4/15/3/0.1/2.5 was used to perform the recording. Then, stable printing was possible, and the obtained printed matter was of the high grade.

What is claimed is:

1. A manufacturing method of a liquid jet head, comprising:

a step of forming a piezoelectric member which generates a discharge pressure for discharging a liquid on a substrate;

a step of disposing a vibration plate on the piezoelectric member;

a step of forming a liquid flow path pattern containing a soluble resin on the vibration plate;

a step of forming a coat layer containing a resin constituting a wall of the liquid flow path on the liquid flow path pattern;

a step of removing the liquid flow path pattern to form the liquid flow path;

a step of removing the substrate; and a step of patterning the piezoelectric member in accordance with the liquid flow path.

2. The manufacturing method of the liquid jet head according to claim 1, further comprising: a step of forming a liquid discharge port in the coat layer between the step of forming the coat layer and the step of forming the liquid flow path.

3. The manufacturing method of the liquid jet head according to claim 1, wherein the step of disposing the vibration plate comprises: laminating the vibration plate on the piezoelectric member or coating the piezoelectric member with a resin constituting the vibration plate.

4. The manufacturing method of the liquid jet head according to claim 1, wherein the coat layer contains an epoxy resin which is solid at normal temperature.

5. The manufacturing method of the liquid jet head according to claim 4, further comprising the steps of: forming the coat layer on the substrate by spin coat or roll coat.

6. The manufacturing method of the liquid jet head according to claim 1, wherein the substrate and a layer of a resin formed on the substrate have optical transmission.

7. A manufacturing method of a liquid jet head comprising:

a step of forming a piezoelectric member which generates a discharge pressure for discharging a liquid on a substrate;

a step of disposing a vibration plate on the piezoelectric member;

a step of forming a liquid flow path pattern containing a soluble resin on the vibration plate;

a step of forming a coat layer containing a resin constituting a wall of the liquid flow path on the liquid flow path pattern;

a step of removing the substrate;

a step of patterning the piezoelectric member in accordance with the liquid flow path; and a step of removing the liquid flow path pattern to form the liquid flow path.

8. The manufacturing method of the liquid jet head according to claim 7, further comprising: a step of forming a liquid discharge port in the coat layer between the step of forming the coat layer and the step of removing the substrate.

9. The manufacturing method of the liquid jet head according to claim 7, wherein the step of disposing the vibration plate comprises: laminating the vibration plate on the piezoelectric member or coating the piezoelectric member with a resin constituting the vibration plate.

10. The manufacturing method of the liquid jet head according to claim 7, wherein the coat layer contains an epoxy resin which is solid at normal temperature.

11. The manufacturing method of the liquid jet head according to claim 10, further comprising the steps of: forming the coat layer on the substrate by spin coat or roll coat.

12. The manufacturing method of the liquid jet head according to claim 7, wherein the substrate and a layer of a resin formed on the substrate have optical transmission.

* * * * *

UNITED STATES PATENT AND TRADEMARK OFFICE

CERTIFICATE OF CORRECTION

PATENT NO. : 6,993,840 B2
APPLICATION NO. : 10/618676
DATED : February 7, 2006
INVENTOR(S) : Akihiro Mouri et al.

It is certified that error appears in the above-identified patent and that said Letters Patent is hereby corrected as shown below:

COLUMN 1
Line 21, “these” should read --over the last--.

COLUMN 7
Line 65, “are formed” (second occurrence) should be deleted.
Line 66, “soluble” should read --solution--.

COLUMN 8
Line 37, “this-manner,” should read --this manner--.

COLUMN 10
Line 8, “5 parts was” should read --5 part¶was--.

COLUMN 11
Line 21, “5 parts was” should read --5 part¶was--.
Line 60, “5 parts was” should read --5 part¶was--.

Signed and Sealed this

Twenty-second Day of August, 2006

JON W. DUDAS
*Director of the United States Patent and Trademark Office*